US007234177B1

(12) United States Patent
Drevitson

(10) Patent No.: US 7,234,177 B1
(45) Date of Patent: Jun. 26, 2007

(54) AUTO HAMMOCK ROCKER

(76) Inventor: Kyle C. Drevitson, 45 Hilltop Trail, Sparta, NJ (US) 07871

( * ) Notice: Subject to any disclaimer, the term of this patent is extended or adjusted under 35 U.S.C. 154(b) by 0 days.

(21) Appl. No.: 11/453,316

(22) Filed: Jun. 14, 2006

(51) Int. Cl.
*A45F 3/22* (2006.01)

(52) U.S. Cl. ..... 5/120; 5/109

(58) Field of Classification Search ..... 5/120, 5/127, 108, 109, 915; 427/119; 601/89, 601/90, 93
See application file for complete search history.

(56) References Cited

U.S. PATENT DOCUMENTS

| | | | | | |
|---|---|---|---|---|---|
| 657,893 | A | | 9/1900 | Lowe | 74/31 |
| 669,980 | A | | 3/1901 | Cutten | 185/38 |
| 751,125 | A | | 2/1904 | Wertz et al. | 5/109 |
| 812,387 | A | | 2/1906 | Wertz | 5/109 |
| 1,420,134 | A | | 6/1922 | Nisle | 5/109 |
| 1,505,117 | A | | 8/1924 | Withun | 472/119 |
| 1,727,635 | A | | 9/1929 | Crane | 5/109 |
| 2,718,226 | A | | 9/1955 | Kaye | 601/65 |
| 2,765,478 | A | * | 10/1956 | Pinto | 5/104 |
| 2,793,375 | A | | 5/1957 | Wardell, Jr. | 5/105 |
| 3,453,999 | A | | 7/1969 | Neal | 601/87 |
| 3,842,450 | A | | 10/1974 | Pad | 5/109 |
| 4,491,317 | A | | 1/1985 | Bansal | 472/119 |
| 4,911,429 | A | | 3/1990 | Ogbu | 472/119 |
| 4,987,624 | A | | 1/1991 | Nafti | 5/109 |
| 5,139,462 | A | | 8/1992 | Gabe | 472/119 |
| 5,574,339 | A | | 11/1996 | Kattwinkel et al. | 318/10 |
| 6,254,490 | B1 | | 7/2001 | Lawson et al. | 472/119 |
| 6,361,446 | B2 | | 3/2002 | Lawson et al. | 472/119 |
| 7,159,254 | B1 * | | 1/2007 | Voorting | 5/120 |

* cited by examiner

*Primary Examiner*—Robert G. Santos
(74) *Attorney, Agent, or Firm*—Ernest D. Buff & Associates; Ernest D. Buff; Dave Narasimhan

(57) ABSTRACT

A rocking machine automatically imparts a continuous, rocking motion to an occupant recumbent on a hammock. One end of the rocking machine is attached to a fixed location. The other end of the rocking machine is attached to a conventional hammock, which is attached to a second fixed location. The rocking machine has a container that houses a periodically reversing geared motor. Operation of the motor is controlled by an electrical circuit having a shaft attached to one end of a torsional spring. The other end of the torsional spring is connected to the hammock. A pressure sensitive switch becomes actuated and moves to a closed position, enabling supply of power to the geared motor that initiates a continuous rocking motion, when the hammock becomes occupied. The electrical circuit provides periodically reversing oscillations while monitoring current to the motor, and decreases the period between oscillations until it matches the natural period of oscillation of the spring-occupant weight system. Motor current is thereby maintained at a decreased value, increasing the efficiency of energy transfer from the motor to rocking motion for said hammock.

9 Claims, 2 Drawing Sheets

AUTO HAMMOCK ROCKER

BACKGROUND OF THE INVENTION

1. Field of the Invention

The present invention relates to a motorized rocking machine for imparting reciprocal, oscillating motion to a hammock; and more particularly, to motorized hammock rocker that automatically sustains the rocking motion of an occupant recumbent on a conventional hammock.

2. Description of the Prior Art

A variety of rockers have been contemplated in the art, enabling oscillating movement of baby carriages, swings, hammocks and the like. These devices include for example, electrical motor driven devices and energy storage devices having spring wound drivers. Oftentimes such prior art devices have too little energy available to sustain the rocking motion, thereby causing the rocker to exhibit movement that is inconsistent with the desired rocking motion of the user. Many of the devices require some form of initiation and do not provide rocking movement automatically when the user climbs onto the hammock.

U.S. Pat. No. 657,893 to Lowe discloses a home hammock motor. This hammock motor is a spring-wound device. It requires an initial push to actuate the rocking motion. The device does not start automatically; but needs an initial push from an attendant.

U.S. Pat. No. 669,980 to Cutten discloses a hammock swinger. This hammock swinger is attached to the ground, and has an arm connected to the hammock by a rope or cable. The arm movement is made possible by a wound up, strong spring. A trip mechanism changes the direction of movement of the arm when the swinging limit of the hammock applies tension to the trip mechanism. During the time that the arm is powering the rocking motion of the hammock, the cable is in tension. When the hammock reaches its rocking limit, the tension is suddenly released. A trip mechanism is thereby activated, and rocking discontinues. Propulsion of the rocker is effected by a strong spring. The '980 patent contains no disclosure concerning the spring winding mechanism.

U.S. Pat. Nos. 751,125 and 812,387 to Wertz et al. disclose a swinging hammock. This swinging hammock is propelled by a spring-powered device that is hinged on a rod proximate to the hammock. The spring-powered device is suspended from a bar which carries the hammock. The spring-powered device is key-wound, and clock-like, having a main spring, a ratchet and pawl, one or more wheels and a pallet wire. An escapement releases the spring's energy to the rocking movement. It is controlled by a release bar, which is maintained plumb by the weight of a person using the hammock. The small spring likely has insufficient energy to rock a hammock when weighted by an occupant.

U.S. Pat. No. 1,420,134 to Nisle discloses a cradle. A rocking motion is imparted to the cradle by a geared down electric motor, which is placed on the base that drives an eccentric connecting rod. The connecting rod imparts oscillating motion to the cradle. A relatively large electric motor is required to provide adequate torque when geared down to rock the cradle and its occupant. Power requirements for the system make it unlikely that rocking motion would be imparted to a hammock when the occupant is an adult.

U.S. Pat. No. 1,505,117 to Withun discloses an electrically operated swing. The rotational speed of the electric motor is first decreased by gearing and is again reduced by a worm gear to rotate a disk. The disk drives an eccentric actuation rod, which pulls on an oscillating lever to rock the cradle. The geared motor must supply high torque to impart all the rocking movement. There is no matching between the harmonic character of swing oscillations and the rotational speed of the disk. The cradle and its occupant are much lighter than a hammock that is occupied by an adult.

U.S. Pat. No. 1,727,635 to Crane discloses an automatic swinging crib. The automatic swinging crib is provided with a solenoid. It is energized by a contact attached to the frame during a portion of the swing cycle, which draws current from a battery. The contact is broken de-energizing the solenoid when the armature reaches the mid point of the solenoid. Energy is thereby provided to the swinging crib at a portion of the swing cycle to combat slowing down of the swing motion. No motors are utilized by the system. The partial cycle solenoid energization is too weak to swing other than small objects, such as a baby. The swinging device disclosed by the '635 patent disclosure is incapable of rocking a hammock occupied by an adult.

U.S. Pat. No. 2,793,375 to Wardell Jr. discloses self-rocking hammock. The hammock is rocked manually by the hammock occupant. Rocking is accomplished, using a foot pedal. No electrical motor is extant in this device. The hammock does not automatically rock when the user climbs onto it. Construction of the hammock is non-standard; the hammock is suspended between rails attached to a semi-circular frame.

U.S. Pat. No. 3,453,999 to Neal discloses an apparatus and process for rocking an infant. A compound-motion infant hammock is placed in an incubator to stimulate the infant's vestibular apparatus. The motor drive oscillates the hammock in the horizontal plane by about 120 degrees, while it rocks the hammock in the vertical plane by about 30 degrees. Rocking of the hammock is atypical. The compound motion generated by the motor drive provides unexpected movement that is unsuited for a conventional hammock.

U.S. Pat. No. 3,842,450 to Pad discloses oscillating furniture and playthings. The oscillating furniture or plaything can comprise a cradle, rocking chair, swinging garden seat, hammock, swing or rocking horse. An electromagnetic oscillation device has a ferromagnetic core movable axially relative to a hollow coil support of an electromagnet. A switch is arranged so that after a given change in the direction of oscillation of the furniture, a circuit is closed to intermittently supply current to the electromagnet and provide oscillation maintaining impulses. There is no electrical motor in this device. A stationary electromagnetic device with a slidable ferromagnetic core is pulled by a hollow electromagnetic coil when energized. The coil is energized intermittently by a switch connected to power supply at a certain portion of the oscillation cycle. This electromagnetic device only sustains the oscillation by supplying a small amount of power during a portion of the oscillation cycle. It cannot initiate an oscillation. For this reason, the oscillating furniture has to be pushed first. If the switch is turned on initially due to the position of the cradle, it is possible to supply uninterrupted power to the coil. The movable ferromagnet becomes stuck within the coil, making it impossible to start the oscillation. The coil is likely burn out due to prolonged passage of current.

U.S. Pat. No. 4,491,317 to Bansal discloses an electrically powered swing for an infant. Swing oscillation is maintained by an intermittently powered solenoid activated by a microswitch tripped by the swinging motion. There is no electrical motor in this device. Closure of the microswitch draws power from a battery in the form of short DC pulses providing power to maintain swinging movement of the infant swing. In order for the solenoid to provide power that maintains the oscillation, the device must first be swung manually. Due to the intermittent nature of energization by the solenoid, only an infant swing may be sustained. Energy mustered by the device is sufficient merely to maintain swings carrying infants. The device has insufficient power to be used on a conventional hammock occupied by an adult.

U.S. Pat. No. 4,911,429 to Ogbu discloses a motorized swing. The swing is attached to a rod, which is mounted on two bases with vertical posts. The rod has two motor drives with L shaped downward facing pivot control arms, and control cables are attached to the infant seat. The relative orientation of these two L shaped pivotal control arms determines whether the infant seat is wobbled or swayed. The device imparts a wobbling or swaying motion to the infant seat. It is unsuited for rocking a hammock occupied by an adult. Multiple control cables effect wobbling or swaying motion to the infant seat. These cables cannot be easily attached to a conventional hammock, which is generally suspended from two fixed locations.

U.S. Pat. No. 4,987,624 to Nafti discloses a device for imparting multi-directional rocking motion. The device is attached to child seat, cradle or rocking horse, using a spring loaded attachment clamp. The motor contained within the housing moves the reciprocating arm, which rests on a stationary surface such as a floor, providing a rocking motion. This device only moves objects up and down; it does not result in a rocking movement. Therefore, this device is unsuited to create rocking motion for a conventional hammock. The rocking motion is not initiated when a person uses the attached device. Accordingly, the movement does not begin when a person climbs onto the hammock.

U.S. Pat. No. 5,139,462 to Gabe discloses an automated swing. This automated swing includes a support frame assembly and a swinging frame assembly pivotally mounted to the support frame assembly. The swing has a pair of parallel elliptical pulleys mounted on a drive shaft driven by a motor drive. A resilient flexible belt is wrapped around the elliptical pulleys and a bearing, and attached to the infant seat suspended on a bar. The elliptical pulleys apply increased tension in one side or other of the belt providing swinging movement. This drive system is suited for swinging an infant seat. The rubber bands are generally not strong and elliptical pulleys only generate limited tension in the resilient belts. Besides, the belts need to be attached to a solid body such as an infant's chair to take advantage of the tension to drive the seat into swinging motion. A conventional hammock is flexible and is not solid. Therefore, a belt tensioned by an elliptical pulley cannot be used to rock a hammock. The elliptical pulleys are on a separate drive shaft and this cannot be provided for a hammock attached between two fixed supports.

U.S. Pat. No. 5,574,339 to Kattwinkel et al. discloses a drive for rocking furniture. A piece of furniture has a frame and a part capable of rocking on the frame at a natural rocking frequency. A drive has a sensor for detecting movement of the part on the frame. A drive motor is connected between the frame and the part for rocking the part on the frame. The sensor detects angular movement, that is, angular speed, angular position, and/or angular acceleration of the part on the frame. A controller is connected between the drive and sensor for rocking the part on the frame at its natural rocking frequency up to a predetermined maximum angular displacement of the part on the frame. The controller has a response field and operates the drive within the specified angular displacement using fuzzy logic. The amount of energy needed to maintain the oscillation is minimal at the eigenfrequency or natural frequency; it is merely enough to overcome frictional and other losses. Limiting the maximum angular travel is easily accomplished regardless of the motor characteristic curve and other parameters. This system uses a fuzzy logic controller that uses response of angular velocity, angular acceleration from a moving part in the rocking moving part to first determine the natural frequency of the part and strive to drive the motor at the natural frequency. At resonance, the energy needed to maintain rocking movement is minimal, but the amplitude of oscillations can build very rapidly unless damping within the system exists. However, the disclosure states that the angular displacement is maintained within the maximum limit. How this objective is achieved is unclear, since at resonance the maximum limit for angular displacement can be easily exceeded.

U.S. Pat. Nos. 6,254,490 and 6,361,446 to Lawson et al. disclose an automated swinging device. This automatic swing device is used in combination with a conventional porch swing. It includes a frame member that will support a conventional porch swing. An automatic swinging device has a fractional horse power motor that runs all the time and uses a clutch to initiate swinging power. An initiation assembly is coupled to the rotating arm assembly. This initiation assembly includes a clutch arm that is connected to a stop unit. The stop unit is connected to the fractional horsepower gear motor. In operation, the user sits on the swing and pushes back, this will cause the rotating arm assembly and active the initiation assembly, disengaging the stop unit. The automatic swinging device is connected to a swing, not a hammock. It does not start swinging as soon as the user gets on the swing. The user has to push back to activate the initiation assembly. The motor is not turned on when the user gets on the swing. It runs all the time. Due to mechanical complexities of this device it is usable with a conventional porch swing, but is not usable with a conventional hammock that is attached to two fixed locations.

Notwithstanding the efforts of prior art workers to provide automatic swinging attachments to a conventional hammock, there is a need for a simple to operate, automatic swinging device attached to a hammock that senses when a user climbs onto a hammock and rocks at a comfortable frequency that is varied in accordance with the weight of the user and an initial movement that is selected by the user.

SUMMARY OF THE INVENTION

The present invention provides a hammock rocking machine comprising a container, a periodically reversing geared motor, and an oscillating portion having a connection member adapted to be attached to a hammock by an attachment portion. The hammock rocking machine has one end connected to a fixed stationary object. The other end of the hammock rocking machine is attached to a conventional hammock. The hammock rocking machine has a large torsional spring attached to the shaft of the geared motor while the other end of the spring is attached to a conventional hammock. When an occupant reclines on and rocks the hammock initially, the torsional spring, together with the weight of the recumbent occupant, creates a natural harmonic oscillator having a characteristic oscillation periodicity. The geared electrical motor, controlled by the electrical circuit, is powered by house current or batteries. It is turned on by a pressure switch incorporated in the hammock, which is closed when the hammock becomes occupied. The motor driving circuit comprises electrical driving circuitry, which periodically reverses the direction of rotation of movement of the motor, while the motor current is monitored. This period of oscillation is gradually decreased from a long period to a value that synchronizes with the periodicity of oscillation of the natural frequency of oscillation of the hammock, at which point the current needed to drive the electrical motor is the lowest.

Generally stated, the unit broadly comprises: (i) a container having a top portion, a bottom portion, and at least one side wall portion arranged to form an internal compartment and an exterior surface; (ii) a periodically reversing low speed geared motor located within said internal compartment of said container; (iii) the geared motor being connected to an oscillating portion; (iv) said oscillating portion comprising a spring member that is connected to the motor shaft in the proximal end and an arm member connected to the spring at the distal end; (v) the arm member is adapted to be integrally attached to a hammock, with a contact switch powering said motor being triggered by the weight of a person on said hammock; (vi) said spring member together with the weight of a person on said hammock constituting a torsional harmonic oscillator having a characteristic periodic resonance oscillation frequency; (vii) said periodic reversal of the motor having a frequency that matches the characteristic frequency of the spring-hammock combination, whereby the periodic reversals of the motor build the characteristic resonance frequency rocking the hammock with an occupant. An attachment portion extending from the top portion of the container is appointed to firmly attach the container to a stationary object to support the Auto Hammock Rocker.

The Auto Hammock Rocker provides a device that automatically rocks a hammock back and forth with an oscillating motion so that a person can fully relax when reclined in the hammock. The Auto Hammock Rocker utilizes a periodically reversing geared motor connected to a spring to impart the oscillating motion at a characteristic frequency that matches the resonance frequency of the spring and weight of the person on the hammock. The geared motor device is disengaged and the oscillating motion stops when the hammock becomes unoccupied.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

Figure 1A:
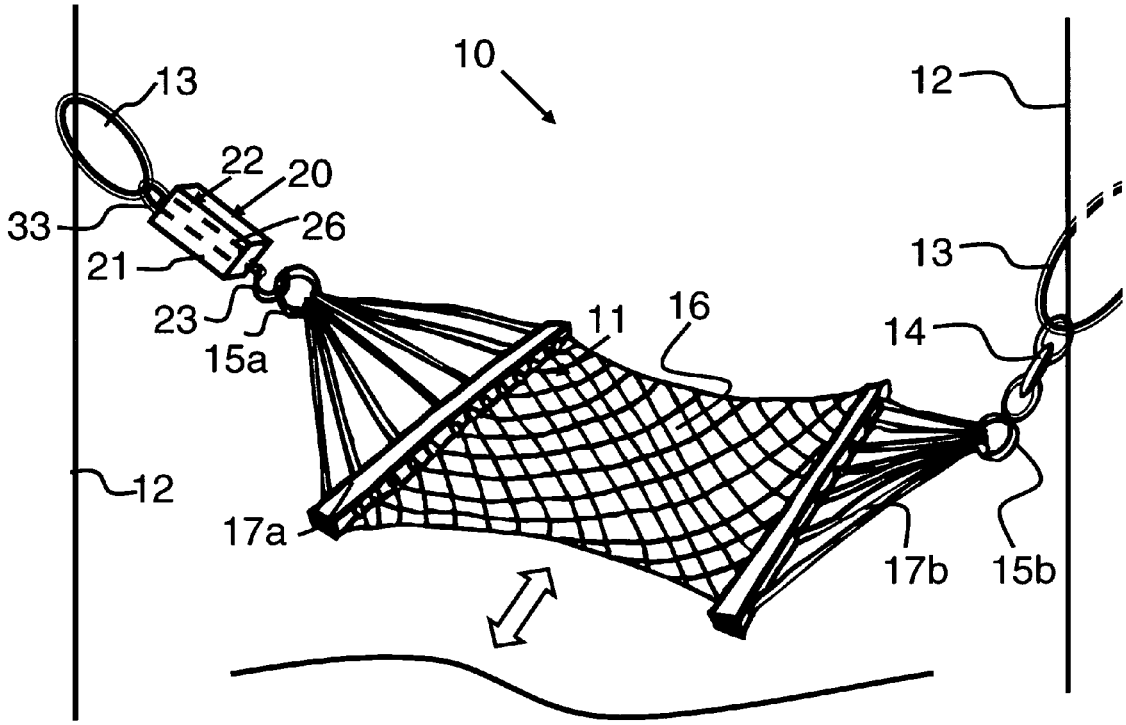
FIG. 1*a* illustrates a lateral view of Auto Hammock Rocker configured with a hammock.

This invention relates to an Auto Hammock Rocker, which gently rocks a hammock occupant as soon as the hammock becomes occupied, thereby relaxing the occupant. A commonly known hammock is firmly attached to a container that is in turn firmly attached to a post or a tree or other stationary objects. The container has a top portion, a bottom portion and at least one side portion defining an internal compartment. The container has more than one side portion and may completely surround the internal compartment, if so desired. The internal compartment houses a periodically reversing geared motor, which may be powered by a battery or house current. The shaft of the geared motor rotates at a slow speed, delivering a high level of torque. The shaft of the geared motor is integrally connected to a torsional spring. The other end of the spring is connected to an arm which, in turn, is connected to the conventional hammock with a pressure switch. The torsional spring and the arm are referred to as the oscillating portion of the Auto Hammock Rocker. When a person lies on the hammock, the pressure switch is activated and the geared motor is thereby powered, creating the rocking motion. The contact pressure switch is generally not required to carry the entire weight of the person on the hammock. It is only a sensor that closes when an occupant's weight, or portion thereof, is applied to the hammock.

The electrical control circuit that periodically reverses the rotation of the gear motor starts out with a longer period, which is slowly decreased by the control circuit. The current drawn by the motor is monitored. It is very low when the reversal period matches the natural rocking period of the torsional spring hammock with the weight of the user. This rocking period is maintained by the electrical control circuit, providing efficient energy transfer to the rocking hammock.

The weight of the person on the hammock together with the spring constant of the spring provides a simple harmonic oscillating system with a well defined characteristic resonance frequency. If the periodic reversal frequency of the motor drive matches this characteristic resonance frequency, energy is progressively transferred from the geared motor to the rocking hammock and even a very small motor drive can power the rocking movement of the hammock. The geared motor fully executes the periodic reversals turning the geared motor shaft through a certain fixed angle and reverses the shaft through the same angle. Even though the hammock is initially stationary and slowly acquires the rocking motion, the periodicity of the characteristic spring-person weight combination is still the same. The initial angular amplitude of the hammock is small. A flexible connection is established between the hammock carrying the person and the spring. The number of ropes that connect the hammock to the arm of the oscillating portion of the Auto Hammock Rocker accommodate the progressively decreasing difference in angular movement of the geared motor shaft and the hammock.

The attachment of the container to a stationary object such as a post or tree may be accomplished by a variety of well-known methods. The key requirement is that the container carrying the hammock be rigidly held in place.

FIG. 1*a* is a lateral view of the Auto Hammock Rocker, shown generally at 20, configured with a hammock. Hammock 11 has a conventional design, comprising a netted support portion 16 and two roped ends 17*a* and 17*b* integrally attached to hammock attachments 15*a* and 15*b*. Generally, as shown herein, hammock attachments 15*a* and 15*b* are provided as rings, and are utilized to attach the right end of the hammock 11 to a stationary object 12. The left end of the hammock is attached to a second stationary object through Auto Hammock Rocker 20. Herein, hammock attachment 15*b* is attached to chain support member 14. Chain support member 14 is connected to the stationary object 12 at attachment point 13. The Auto Hammock Rocker is directly attached to hammock at attachment 15*a*. It comprises a container 21 having a geared motor 24 located therein. Geared motor 24 is connected to an oscillating portion 22 adapted to be connected to the hammock 11. Oscillating portion 22 further comprises an arm member 23. The Auto Hammock Rocker 20 includes an attachment portion 33 extending from the container 21, which is adapted to attach the container 21 directly to an object 12 at attachment point 13.

Figure 1B:
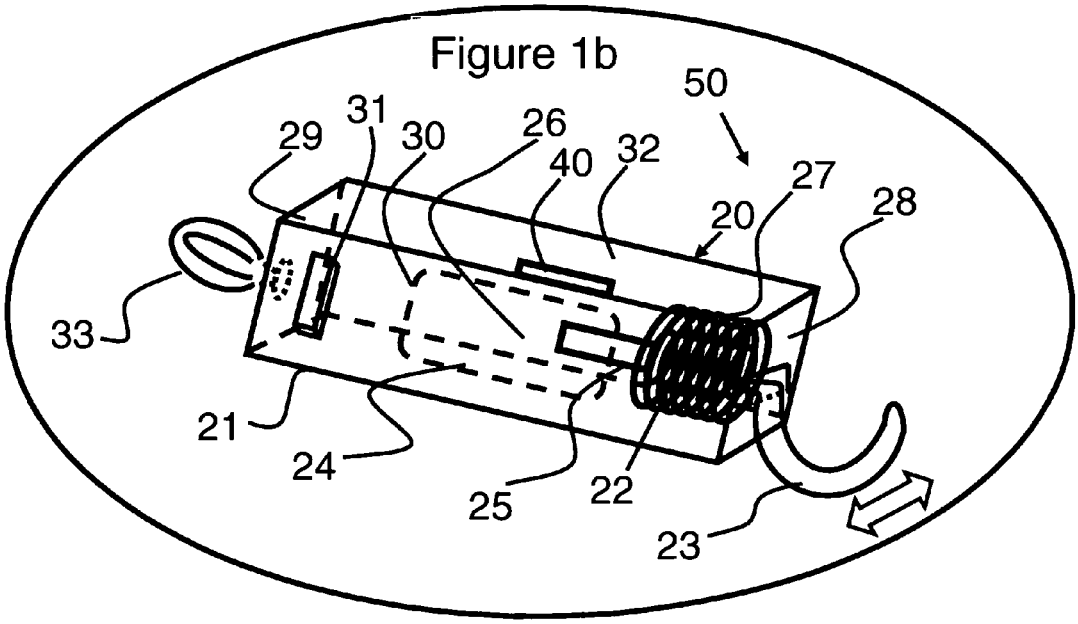
FIG. 1*b* depicts the Auto Hammock Rocker in greater detail.

FIG. 1*b* shows the Auto Hammock Rocker 20 in greater detail at 50. The Auto Hammock Rocker 20 comprises container 21 having a top portion 29, bottom portion 28, and at least one side wall portion 32 arranged to form an internal compartment and an exterior surface. Bottom portion 28 includes an elongated aperture 27. Sidewall portion 32 of container 21 has four side wall portions 32 constructed to form a container 21 of generally rectangular shape. Container 21 can have a varying number of sidewall portions 32 and therefore can be configured to form a number of various shapes. A periodically reversing geared motor 24 is located within the internal compartment of the container 21. The electrical circuit board 40 controls the periodic reversal and monitors motor current. The geared motor 24 can have the construction of a typical oscillating motor. It has a motor shaft 25. A torsional spring 27 has one end connected to the geared motor shaft 25. The other end of the torsional spring 27 is connected to arm 23. This arm 23 is connected to ring 15*a* as shown in FIG. 1*a*. In an alternate embodiment, the periodically reversing geared motor drives a worm and worm gear that is connected to a spring.

The Auto Hammock Rocker 20 further comprises a pressure switch 31. The pressure switch 31 is activated by the weight of an occupant that is recumbent on the hammock 11 and powers the motor. When the occupant gets down from the hammock, the pressure switch opens, shutting off the motor. The overall weight of the occupant need not be supported by the pressure switch, which is a sensor and easily triggered by a small portion of the occupant's total weight. The pressure switch is shown here to be located within the container 21, but it may be equally well positioned outside the container 21.

Figure 2:
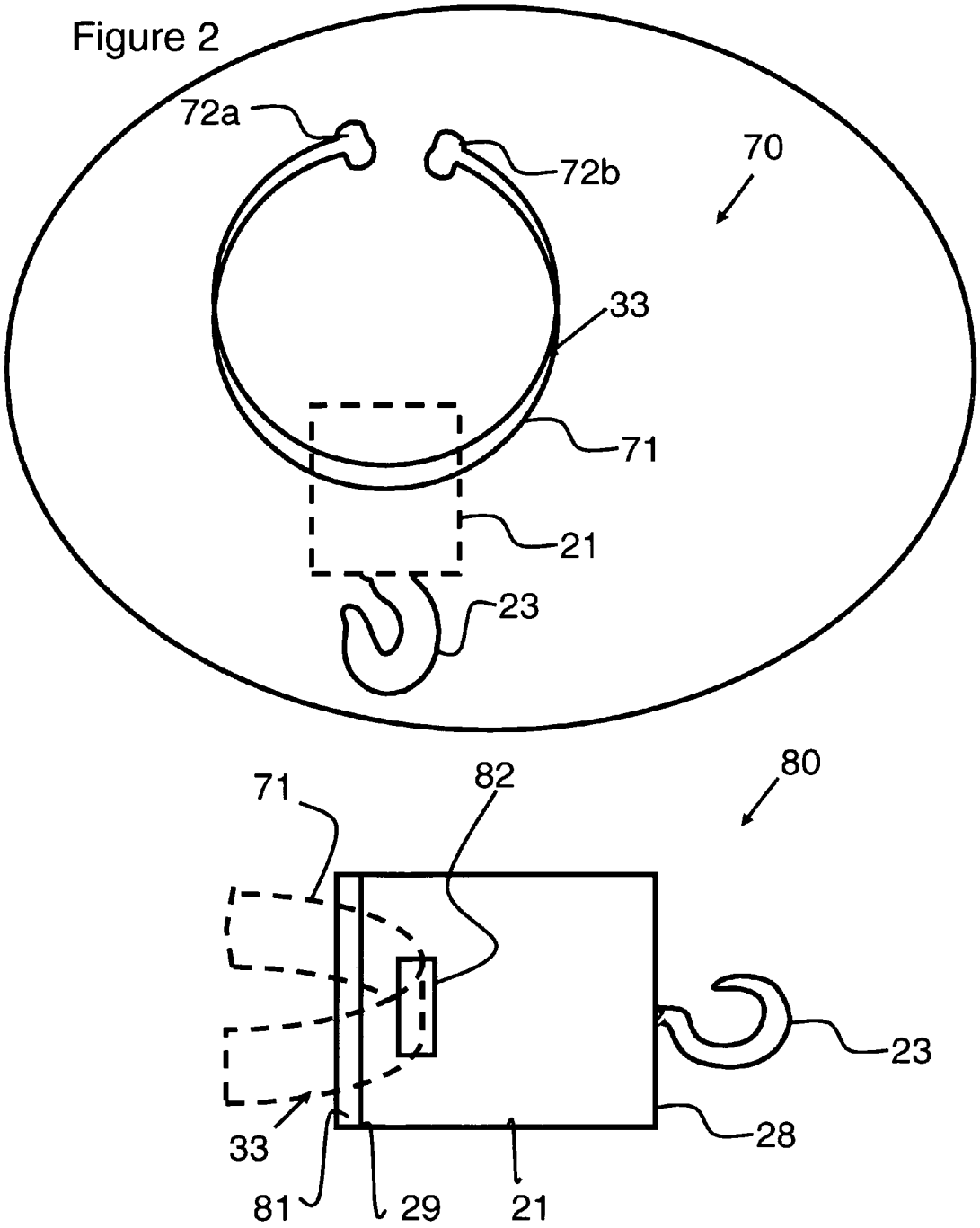
FIG. 2 shows the Auto Hammock Rocker attachment portion.

In FIG. 2 the attachment portion 33 is shown generally at 70 and 80. Attachment portion 33 can be arranged to comprise an adjustable strap 71. The adjustable strap 71 is integrally attached to attachment portion 33. The adjustable strap 71 is provided with adjustment means 72*a* and 72*b* adapted to be connected to one another. The Auto Hammock Rocker 20 can be directly attached around the stationary object 12 of FIG. 1*a* (tree or post). As shown at 80, a form fitting rubber pad 81 may be fixed to the top portion 29 of container 21. A hole 82 is provided so that adjustable strap 71 of attachment portion 33 can pass therethrough to attach the Auto Hammock Rocker 20 to a stationary object 12 of FIG. 1*a*. In this arrangement, the top portion 29 of the container 21 is in intimate contact with the stationary object 12.

The key features of the Auto Hammock Rocker comprise in combination the components set forth below:

1) A container having a top portion, bottom portion and at least one side portion forming an internal compartment that houses a periodically reversing geared motor, the shaft of which is connected to a torsional spring;
2) the torsional spring having a distal end connected to an arm that carries the hammock through a contact switch, which closes by the weight of an occupant recumbent on the hammock;
3) the torsional spring, in combination with the weight of the occupant, forming a harmonic oscillator having a characteristic resonance frequency that is designed to be matched with the periodic reversal frequency of said motor;
4) the geared motor periodically reversing direction of shaft rotation and storing energy on the spring, which is delivered to the hammock rocking the occupant automatically; and
5) the geared motor turning off when the hammock becomes unoccupied, whereby upon becoming occupied the hammock is placed in an "on" condition that provides a relaxing rocking movement, and upon becoming unoccupied, the hammock is placed in an "off" condition that stops the rocking movement.

Having thus described the invention in rather full detail, it will be understood that such detail need not be strictly adhered to, but that additional changes and modifications may suggest themselves to one skilled in the art. For example, the rocking machine may be provided with an ON/off switch adapted to override the system, for occupants with motion sickness or occupants that simply want to lay still. A power cord can be provided from the rocking machine to the hammock, to control rocking speed and actuate the ON/off condition in the manner of a TV remote. It would be especially advantageous if the power cord were removably attached to the hammock by a hook and loop fastening mechanism or the like, making it readily accessible to the occupant. Each of these modifications is intended to fall within the scope of the invention as defined by the subjoined claims.

What is claimed is:

1. A rocking machine for imparting a continuous rocking motion to an occupant recumbent on a hammock, comprising:

a. a container having a top portion, a bottom portion and at least one side portion forming an internal compartment;
b. said internal compartment housing a periodically reversing, geared motor having a shaft;
c. said periodic reversal of said geared motor being controlled by an electrical control circuit that monitors motor current;
d. said motor shaft being connected to the proximal end of a torsional spring;
e. a distal end of said torsional spring being adapted for connection to one end of a hammock;
f. said container being firmly secured to a fixed, external location;
g. a pressure sensitive switch that, upon being actuated, moves to a closed position enabling supply of power to said periodically reversing geared motor, whereby upon being connected to said hammock, the periodicity of said motor reversals is slowly decreased from a longer reversal period to a reversal period which matches the natural periodic rocking motion imparted by the combined effect of the torsional spring and weight of an occupant recumbent on the hammock, thereby decreasing motor current and increasing efficiency of energy transfer from said periodically reversing geared motor to rocking motion for said hammock.

2. The rocking machine recited by claim 1, wherein said pressure switch is actuated in response to the presence of a portion of the weight of said occupant.

3. The rocking machine recited by claim 2, wherein the period of oscillation of said hammock is adjusted by said control circuit according to weight of the occupant.

4. The rocking machine recited by claim 1, wherein said periodically reversing geared motor and said electrical circuit are powered by a battery.

5. The rocking machine recited by claim 1, wherein said periodically reversing geared motor and said electrical circuit are powered by house current.

6. The rocking machine recited by claim 1, wherein the periodically reversing geared motor is turned off by movement of said pressure switch to an open position, interrupting supply of power, when said hammock becomes unoccupied.

7. The rocking machine recited by claim 1, further comprising an ON/off switch adapted to override automatic activation of said pressure switch.

8. The rocking machine recited by claim 7, wherein said ON/off switch is electrically connected to said rocking machine through a power cord removably attached to said hammock.

9. The rocking machine recited by claim 8, wherein said removable attachment comprises a hook and loop fastening mechanism.

* * * * *